US005427049A

United States Patent [19]

Mardikian

[11] Patent Number: 5,427,049

[45] Date of Patent: Jun. 27, 1995

[54] SELF-RETRACTING STEP ASSEMBLY FOR PERSONAL WATERCRAFT

[75] Inventor: Albert Mardikian, Corona Del Mar, Calif.

[73] Assignee: Mardikian 1991 Irrevocable Trust, Corona Del Mar, Calif.

[21] Appl. No.: 261,458

[22] Filed: Jun. 17, 1994

[51] Int. Cl.[6] ..... B63B 17/00

[52] U.S. Cl. ..... 114/362; 182/97; 114/274

[58] Field of Search ..... 114/343, 361, 362, 363, 114/364, 271, 274; 182/91, 93, 95, 97, 124

[56] References Cited

U.S. PATENT DOCUMENTS

| | | | |
|---|---|---|---|
| 3,825,097 | 7/1974 | Owen | 181/91 |
| 3,862,670 | 1/1975 | Hovey | 182/89 |
| 3,986,503 | 10/1976 | LeGuillon | 182/89 |
| 4,146,941 | 4/1979 | Haslam | 114/362 |
| 4,191,388 | 3/1980 | Barksdale | 280/166 |
| 4,556,125 | 12/1985 | Johnson | 182/91 |
| 4,688,508 | 8/1987 | Nishida | 114/362 |
| 4,712,503 | 12/1987 | Ritten | 114/343 |
| 4,738,642 | 4/1988 | Koyama et al. | 440/38 |
| 4,926,965 | 5/1990 | Fox | 182/89 |
| 4,979,454 | 12/1990 | Van Den Heuvel | 114/270 |
| 4,995,839 | 2/1991 | Hahns | 114/274 |
| 5,014,640 | 5/1991 | Owen, Sr. | 114/362 |
| 5,152,244 | 10/1992 | Jarmillo, Jr. et al. | 114/362 |

FOREIGN PATENT DOCUMENTS

| | | | |
|---|---|---|---|
| 254092 | 10/1990 | Japan | 114/362 |

*Primary Examiner*—Stephen P. Avila
*Attorney, Agent, or Firm*—Klein & Szekeres

[57] ABSTRACT

A retractable step or ladder is mounted to the rear of the personal watercraft. The retractable step has a pair of hollow channel members fixedly mounted underneath the riding platform. An elongated rigid member is mounted to each channel member by springs which permit substantially horizontal travel of each elongated member relative to the channel member until a stop is reached. The springs bias each elongated member into positions where the elongated members are not extended relative to the channel members, however the biasing force of the springs can be overcome by moderate effort of the user of the watercraft who wishes to climb aboard the watercraft from the water. Camming surfaces are formed substantially at the end of each channel member and at the end of each elongated member, and the camming surfaces mate and allow a downward pivoting motion of the elongated members about a hinge pin only when the elongated members are extended until the stop is reached. The cooperating camming surfaces prevent the biasing force of the springs from retracting the elongated members when the elongated members are positioned in the downward direction. A cross bar is disposed substantially at the remote ends of the elongated members, and has a water foil surface mounted thereon.

20 Claims, 5 Drawing Sheets

SELF-RETRACTING STEP ASSEMBLY FOR PERSONAL WATERCRAFT

FIELD OF THE INVENTION

The present invention is directed to a self-retracting step assembly to be used in conjunction with personal watercraft.

BRIEF DESCRIPTION OF THE PRIOR ART

Personal watercraft are well known in the art. Such craft typically employs a jet pump for generating a rearwardly directed stream of water which provides the forward thrust required to propel the craft and its occupant. The direction of propulsion is controlled by the positioning of a movable steering nozzle which receives the stream of water from the pump and directs the flow so as to divide the thrust into the desired directional components. The positioning of the nozzle is affected by a steering cable system which connects the nozzle to a handlebar controlled by the driver of the watercraft. The handlebar typically includes a throttle control and an electrical on and off switch. U.S. Pat. No. 5,092,260 describes a personal watercraft which has an adjustable flap on the bottom of the craft, so that the angle at which the flap meets the water can be controlled by the operator of the craft. The flap can also serve as a brake. As far as the arrangement for accommodating the driver/occupant of the personal watercraft is concerned, one type of personal watercraft requires the occupant to stand on the watercraft while riding. This type of watercraft is also commonly known as a "jet ski". Although jet skis of this type are popular, a related sit-down type of personal watercraft has also recently gained great popularity. Such "sit-down" models include a seat which the driver usually occupies in sitting reclined or semi-prone position to drive the watercraft. Climbing aboard or mounting personal watercraft, however can be difficult. This is a serious problem pertaining to the recreational use of personal watercraft because it is well known that both "stand-up" and "sit-down" types of personal watercraft tend to be driven fast on the water and that their occupant frequently falls off the watercraft, and is therefore frequently obliged to climb aboard again, from the water. Since climbing aboard the personal watercraft requires considerable coordination and skill, for many people the need for repeatedly performing this task detracts from the pleasure of recreational use of the personal watercraft. In order to overcome this problem the prior art has provided various types of steps, ladders or "stirrups" mounted in some fashion or another to the rear of the personal watercraft. Such devices (as well as steps or ladders to facilitate entry into other types of vehicles) are described in U.S. Pat. Nos. 5,152,244; 5,014,640; 4,979,454; 4,926,965; 4,738,642; 4,712,503; 4,556,125; 3,986,503; 3,862,670, and 3,825,097. In spite of the availability of steps, stirrups or ladders in the prior art to facilitate climbing aboard personal watercraft, there is still ample room in the art for improvement in this field, particularly in terms of ease and cost of construction, operation and convenience to the user of such devices. The present invention provides such an improvement.

SUMMARY OF THE INVENTION

It is an object of the present invention to provide a step or ladder mounted towards the rear of a personal watercraft, which can be used to facilitate climbing aboard of the personal watercraft from the water.

It is another object of the present invention to provide a step or ladder mounted towards the rear of a personal watercraft which meets the foregoing objective, and which is easy and safe to use.

It is still another object of the present invention to provide a step or ladder mounted towards the rear of a personal watercraft which meets the foregoing objectives and which retracts automatically into a stowed-away position as soon as the personal watercraft substantially moves in the water.

The foregoing and other objects and advantages are attained by a retractable step or ladder which has a pair of hollow channel members fixedly mounted to the rear of the personal watercraft underneath the riding platform. An elongated member is mounted to each channel member by spring means which permit substantially horizontal travel of each elongated member relative to the channel member, until a stop is reached. The spring means bias each elongated member into positions where the elongated members are not extended relative to the channel members, however the biasing force of the spring means can be overcome by moderate effort of the user of the watercraft who wishes to climb aboard the watercraft from the water. Camming surfaces are formed substantially at the end of each channel member and at the end of each elongated member, and the camming surfaces mate and allow a downward pivoting motion of the elongated members about a hinge pin, only when the elongated members are extended until the stop is reached. The cooperating camming surfaces prevent the biasing force of the springs means from retracting the elongated members when the elongated members are positioned in the downward direction. A cross bar is disposed substantially at the remote ends of the elongated members, and has a water foil surface mounted thereon. A user wishing to climb aboard the watercraft from the water steps on the cross bar and the water foil while these items are in the water, with the elongated members extended and disposed in a downward direction. Motion of the watercraft, after the user has climbed aboard, causes drag on the water foil surface and upward pivoting motion of the elongated members on the hinge pin, which are then no longer restricted by the camming surfaces and are retracted into the channel members by the spring means.

The features of the present invention can be best understood together with further objects and advantages by reference to the following description, taken in connection with the accompanying drawings, wherein like numerals indicate like parts.

DESCRIPTION OF THE PREFERRED EMBODIMENT

The following specification taken in conjunction with the drawings sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Figure 1:
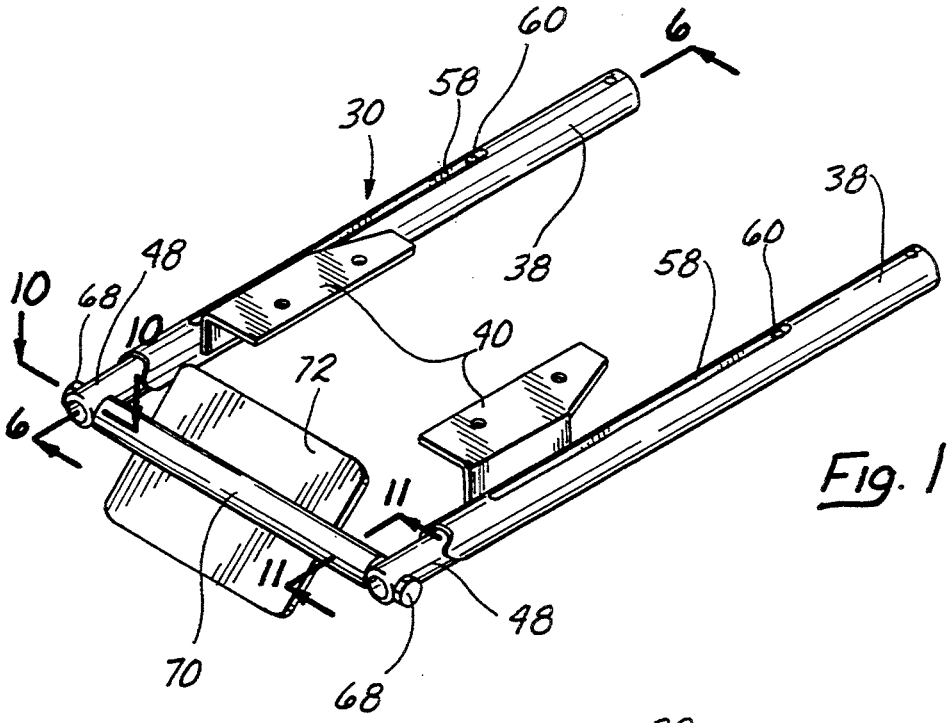
FIG. 1 is a perspective view of the self-retracting step assembly of the present invention, showing the assembly in a retracted position.
Figure 2:
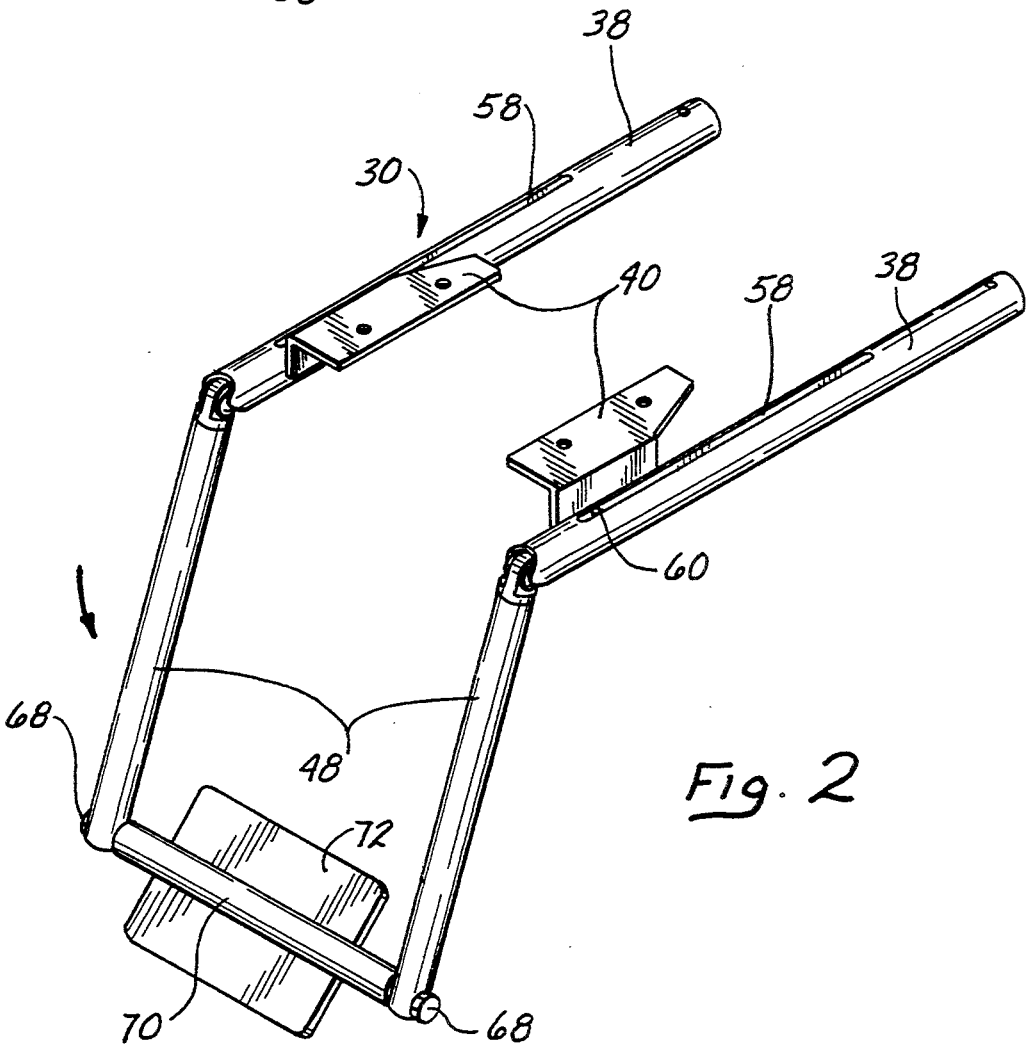
FIG. 2 is a perspective view of the self-retracting step assembly, showing the assembly in an extended position in which it is used to facilitate mounting of a personal watercraft.
Figure 3:
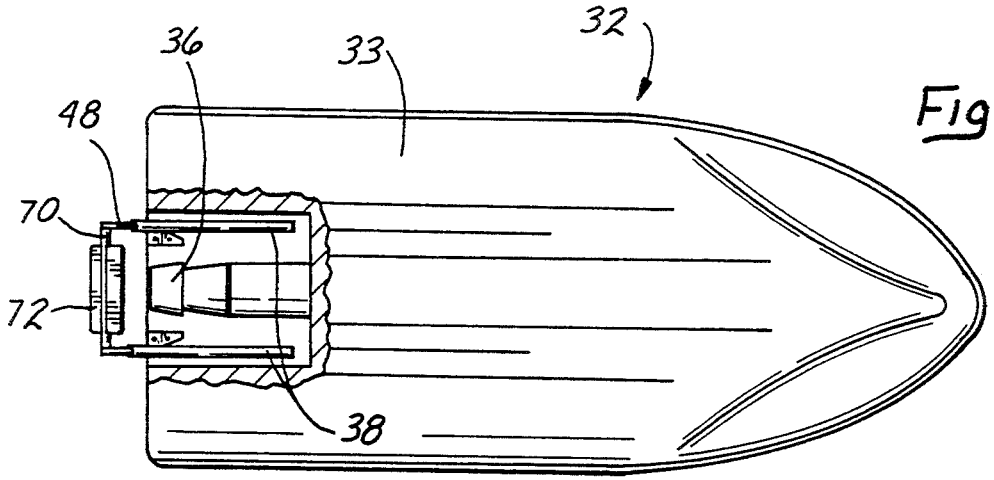
FIG. 3 is a bottom view of a personal watercraft to which the self-retracting step assembly is mounted.
Figure 4:
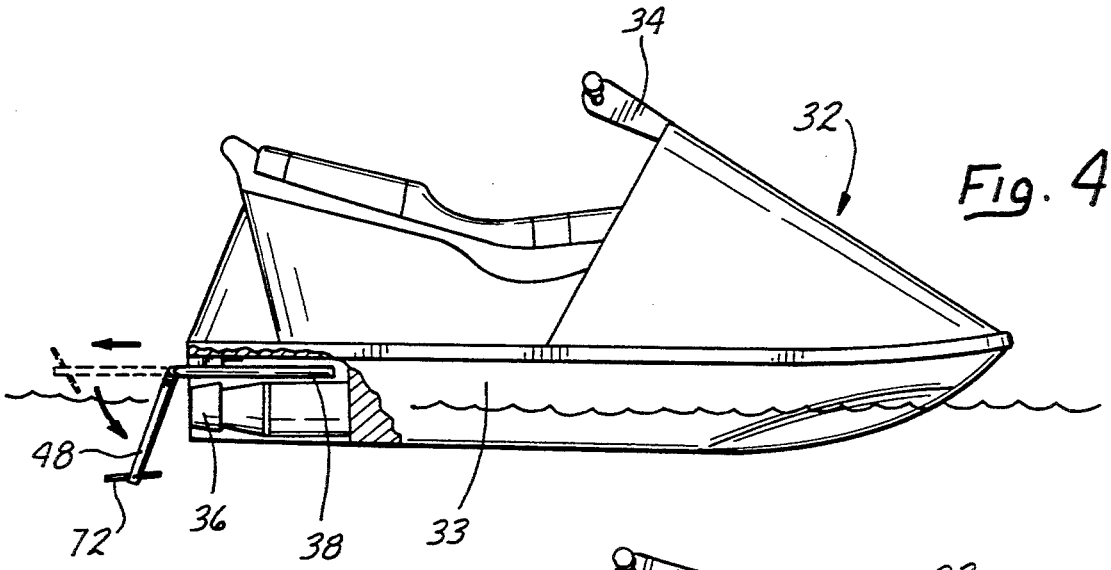
FIG. 4 is a side view of the personal watercraft to which the self-retracting step assembly is mounted, the view showing the step-assembly being extended, while the watercraft is still in the water.
Figure 5:
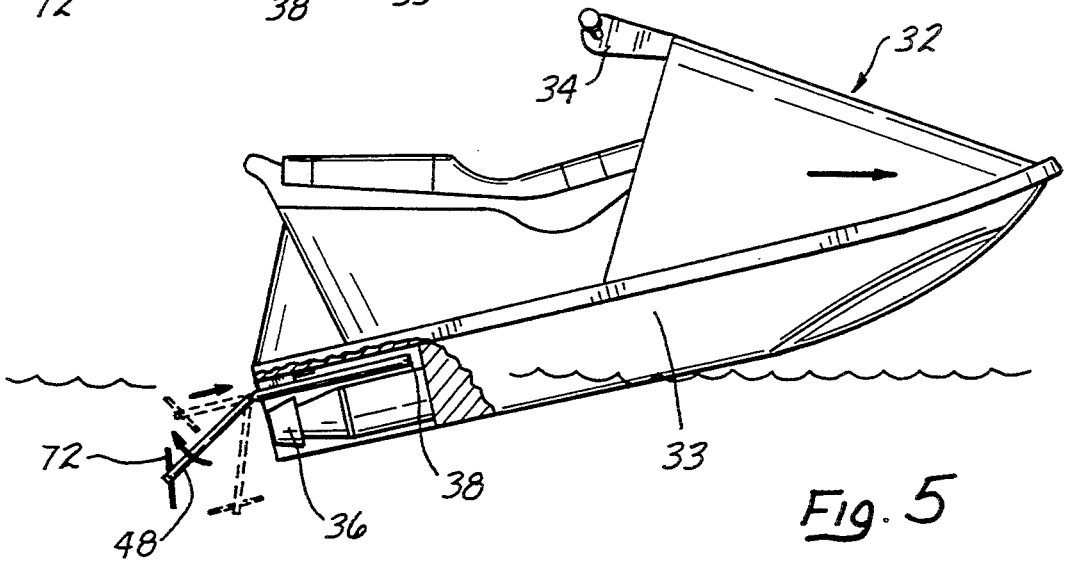
FIG. 5 is another side view of the personal watercraft to which the self-retracting step assembly is mounted, the view showing the step-assembly being retracted while the watercraft moves in the water.
Figure 12:
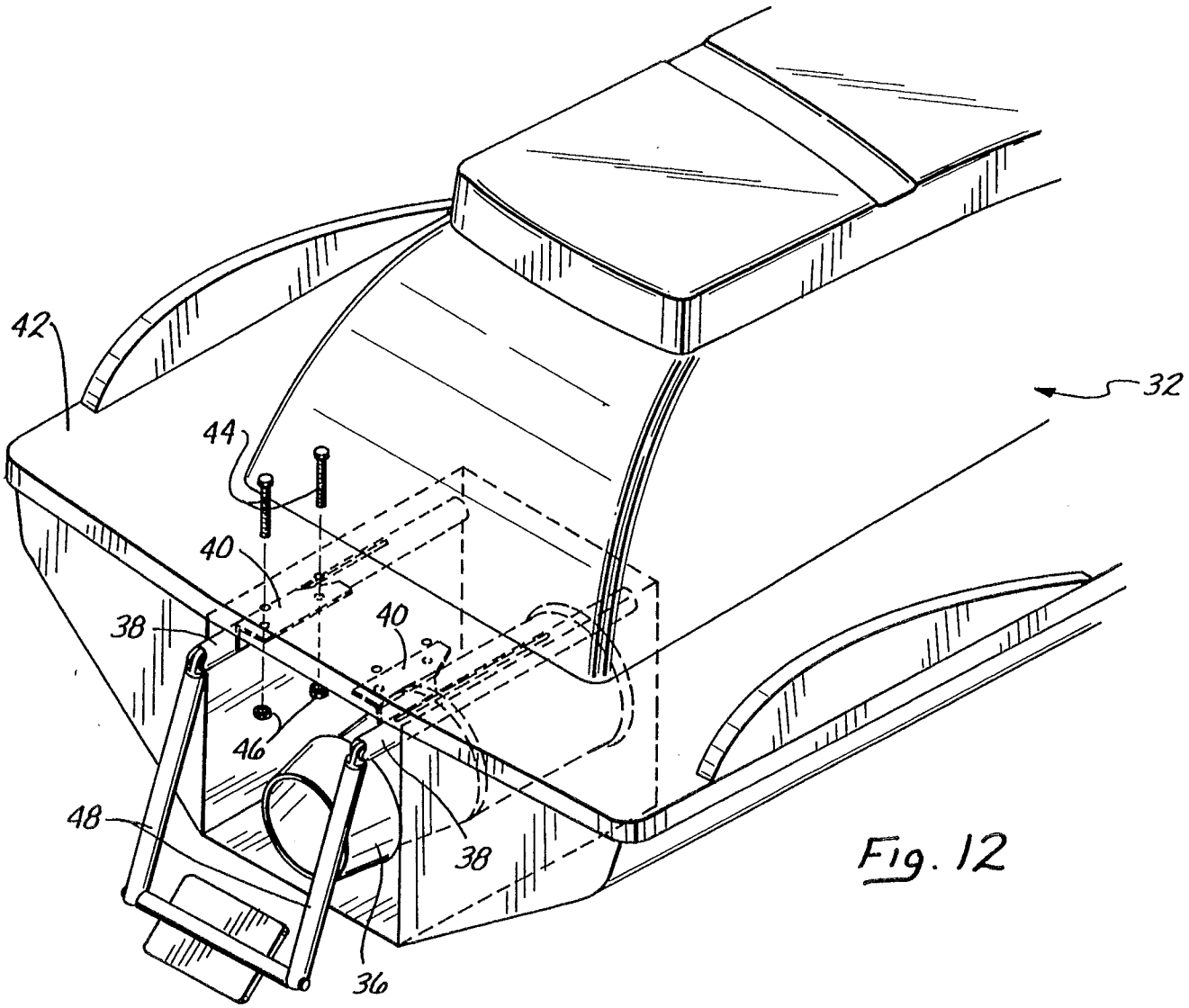
FIG. 12 is a perspective view showing the mounting of the retractable step assembly of the present invention to the rear of the personal watercraft.

Referring now to the drawing figures, and particularly to the perspective views of FIGS. 1, 2 and 12, the self-retracting step assembly 30 of the present invention is disclosed. In the herein described embodiment the self-retracting step assembly 30 is mounted to a personal watercraft 32 of the type which is driven by its sole occupant in a sit-down or semi-prone position. However, it should be understood that the self-retracting step assembly can also be utilized in connection with the stand-up type of personal watercraft. The personal watercraft itself may be of state-of-the-art construction and includes a hull 33, a steering column 34 an engine (not shown) jet pump or propeller (not shown), and a jet nozzle 36. As is known in the art, the occupant/driver steers the watercraft 32 by turning the steering column 34 which controls orientation of the jet nozzle 36. The components of the personal watercraft 32 which have been hitherto described are conventional, well known and therefore their further and detailed description is not necessary.

Figure 6:
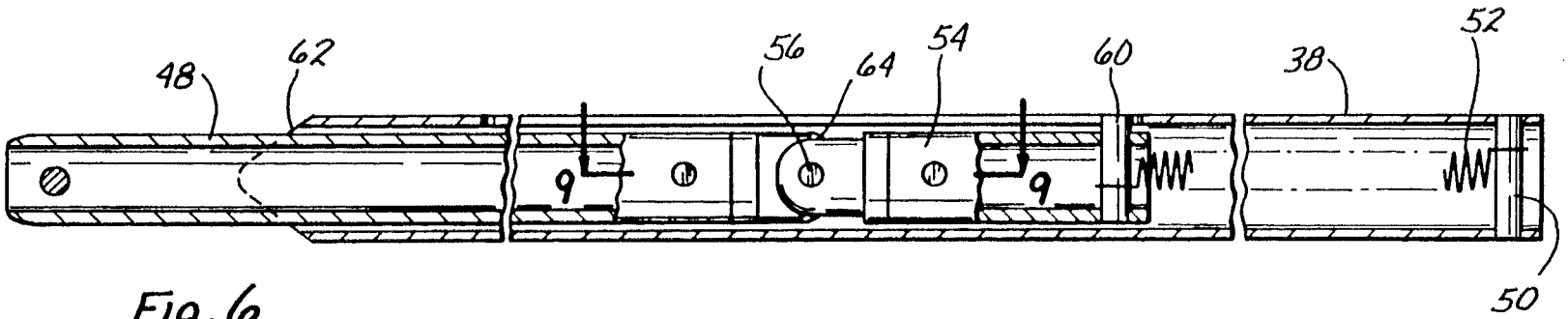
FIG. 6 is a cross-sectional view of the self-retracting step assembly, the view taken on lines 6,6 of FIG. 1.
Figure 7:
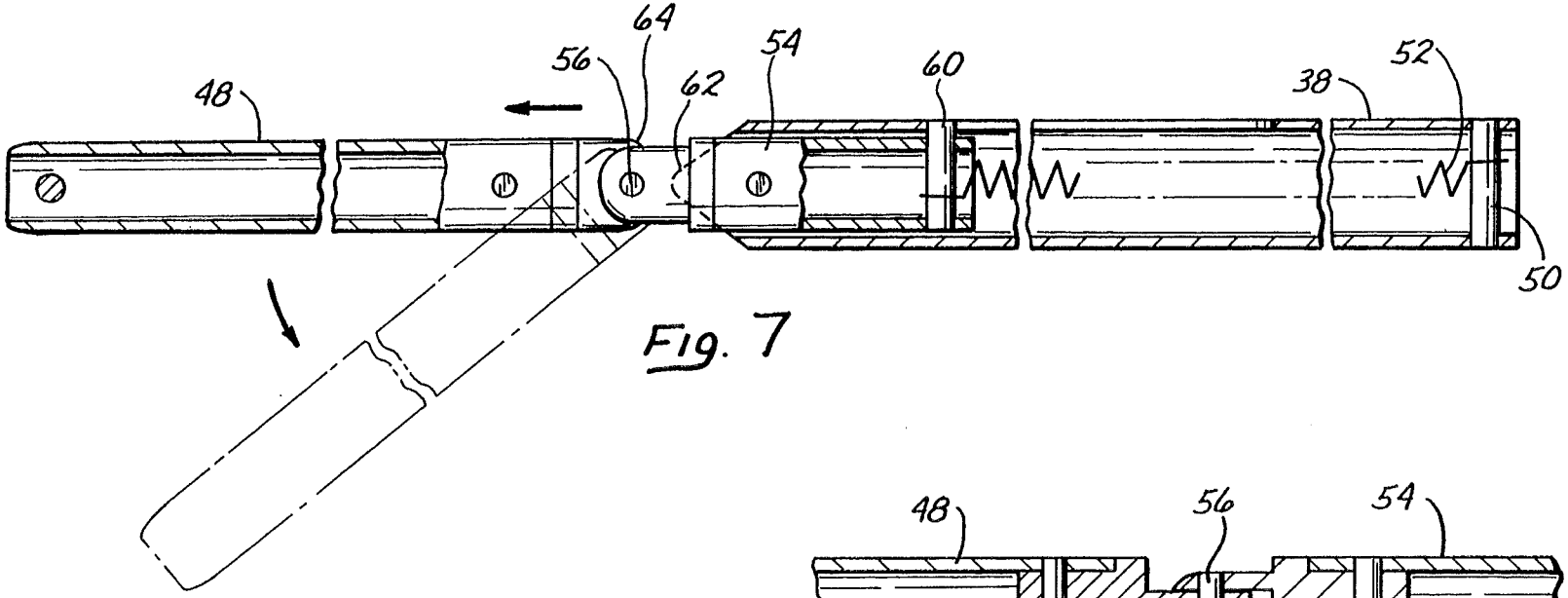
FIG. 7 is a cross-sectional view analogous to the cross-sectional view of FIG. 6 but showing the step assembly in the process of being extended.
Figure 9:
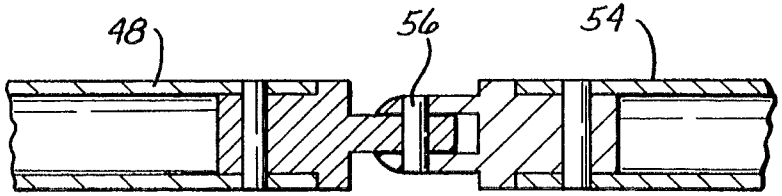
FIG. 9 is a cross-sectional view taken on lines 9,9 of FIG. 6.

As is shown in the drawing figures, the step assembly 30 includes a pair of hollow tubular channel members 38. A bracket 40 is fixedly attached to each channel member 38 and is used to fixedly mount the channel member 38 underneath the riding platform 42 of the watercraft 32, with bolts 44 and nuts 46 shown in FIG. 12. In other embodiments the channel members can be installed above the riding platform. In the herein described preferred embodiment the channel members 38 comprise aluminum tube of approximately 1" diameter. Instead of aluminum stainless steel or strong plastic can also be used. An elongated member 48, which in the herein described preferred embodiment also comprises aluminum tube (of approximately ¾" diameter) is mounted within the interior of each channel member 38. A first pin 50 is disposed substantially at the end of each channel member 38 and a coil spring 52 is attached to the pin 50. A sliding member 54, comprising a aluminum tube section of shorter length than the elongated member 48 is also mounted within the interior of each channel member 38 and is attached to the coil spring 52. A substantially horizontally disposed second pin 56 is mounted substantially at the end of the sliding member 54, and the elongated member 48 is mounted to the second pin 56 so that the elongated member 48 can rotate about the second pin 56 in the up-and-down direction. The rotatable mounting of the elongated member 48 to the second pin 56 of the sliding member 54 is shown in detail in the cross-sectional view of FIG. 9 and on FIGS. 6, 7 and 8. A longitudinal blind slot 58 is provided in the upper surface of each channel member 38, and a vertically disposed third pin 60 is mounted in the sliding member 54. The pin 60 is of sufficient length to travel in the blind slot 58. As is shown in FIGS. 6 and 7, the coil spring 52 is attached to the sliding member 54 through the pin 60. The pin 60, which travels in the slot 58 thus provides a limit or stop to the forward sliding motion of the sliding member 54 and of the elongated member 48 within the channel member 38.

Figure 8:
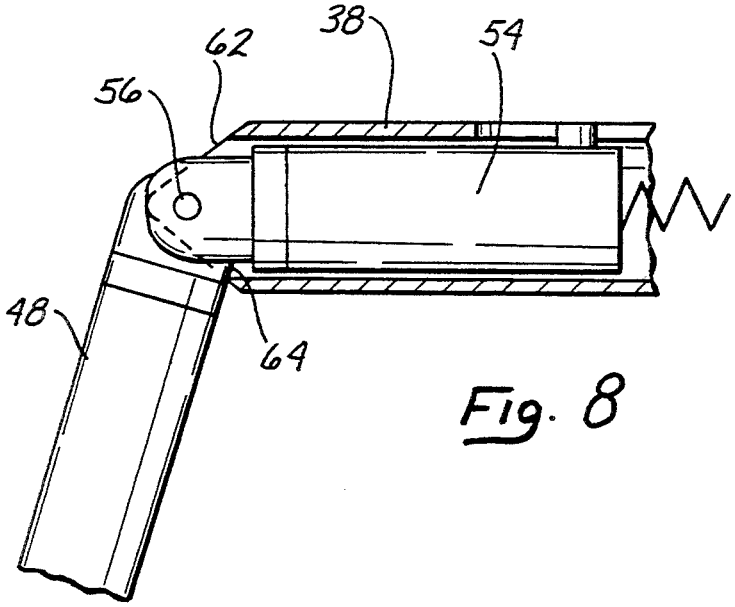
FIG. 8 is a cross-sectional partial view analogous to the cross-sectional view of FIG. 6, showing the step assembly in the extended position.
Figure 10:
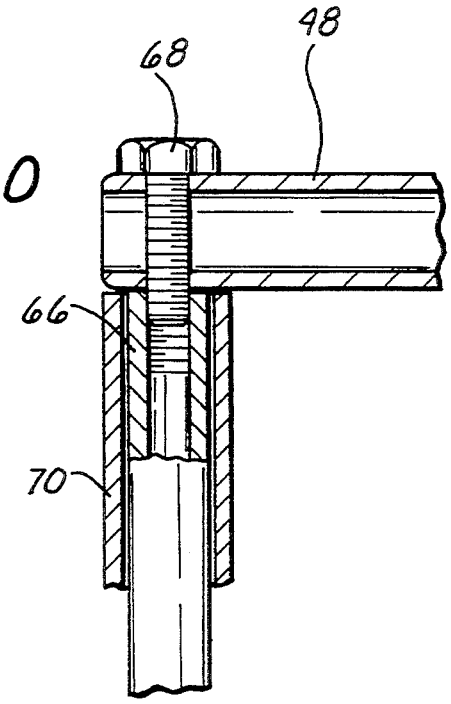
FIG. 10 is a cross-sectional view taken on lines 10,10 of FIG. 1.
Figure 11:
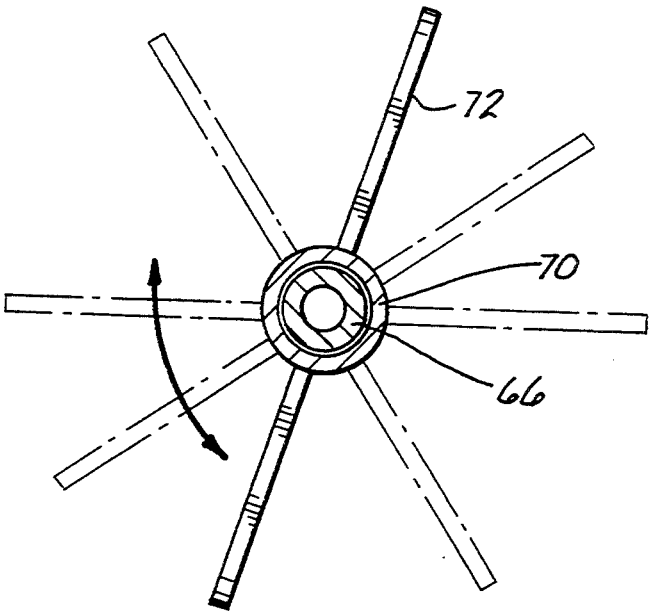
FIG. 11 is a cross-sectional view taken on lines 11,11 of FIG. 1.

Referring still primarily to FIGS. 6, 7 and 8, cooperating camming surfaces 62 and 64 are shown, formed at the respective ends of the channel members 38 and the elongated members 48. When the sliding member 54 and elongated member 48 have reached their fully extended position the pin 56 permits downward rotation of the elongated members 48 relative to the channel members 38, and the cooperating camming surfaces 62 and 64 render the downward pivoting motion relatively smooth and easy to accomplish by moderate human effort, despite the biasing force of the springs 52. The camming surfaces also keep the extended elongate members in the desired angular position shown in FIGS. 2, 8, and 12, which in the herein described preferred embodiment is about 20 degrees off the perpendicular (approximately 110 degrees from horizontal). As it will be readily understood by those skilled in the art from the foregoing description and inspection of the drawing figures, when the elongated members 48 are sufficiently inclined relative to the channel members 38 the biasing force of the springs 52 has no noticeable effect, and does not retract the elongated members 48 into the channel members 38.

Referring now primarily to FIGS. 1, 2, 10, and 12, a cross member 66 is shown which in the herein described preferred embodiment also comprises aluminum tube. The cross member 66 is mounted between the elongated members 48 with bolts 68. A second cross member 70, which comprises aluminum tube of larger diameter than the first cross member 66, is rotatably mounted on the first cross member 66. Detail of this mounting is best shown on FIG. 10. A substantially flat member or plate 72, is welded to the second cross member 70. The cross members 66, 70 and plate 72 form a step, or ladder rung on which a person (not shown) may step when desiring to climb aboard the personal watercraft 32 from the water (not shown). The plate 72 also forms a water foil which creates substantial drag and may rotate when the watercraft moves forward and the plate 72 is dragged in the water.

The operation and utilization of the self-retracting step assembly 30 of the present invention should be readily apparent to those skilled in the art from the foregoing description and drawings. Thus the retracted or stowed-away position of the elongated members 48 is the normal, at rest, position of the self-retracting step assembly 30. In this position the elongated members 48, cross members 66, 70 and water foil 72 are out of the water, and above the stream of water ejected by the jet nozzle 36. When the watercraft 32 is substantially still in the water (not shown) and a person (not shown) wishes to climb aboard the watercraft 32, he or she can get hold of the cross member 70, water foil 72 or both, and pull the elongated members 48 outwardly from the channel members 38 against the biasing force of the coil springs 52. At the end of the possible travel of the elongated members 48 they are moved in a downwardly direction to rotate about the pin 56 so that the cross member 70 and water foil 72 are placed into the water (not shown), with the water foil 72 being below the potential stream of water from the jet nozzle 36. In this position the extended step assembly is stable and is used to facilitate climbing aboard the watercraft 32. After the person (not shown) has mounted the watercraft 32, the jet pump (not shown) is significantly energized, and the watercraft 32 starts to move in the water, the water foil 72 being dragged in the water creates an upward directed force which causes the extended assembly to bend upwardly, and automatically become retracted by the biasing force of the springs 52. In its retracted position the step assembly does not interfere at all with the movement of the watercraft 32.

Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. A self-retracting step assembly for a personal watercraft, comprising:

a pair of channel members being fixedly and substantially horizontally mountable to the rear of the personal watercraft;

a pair elongated members, each elongated member being mounted to one channel member for relative sliding motion thereon in a substantially horizontal direction;

spring means affixed to the channel members and to the elongated members for creating a substantially horizontal biasing force, biasing each elongated member into a substantially retracted position relative to the channel member;

stop means for limiting the travel of each elongated member relative to the channel member in the outward direction against the biasing force of the spring;

hinge means for permitting down .and up rotation of the elongated members relative to the channel members when the elongated members are fully extended relative to the channel members;

camming surface means formed at least on one of the channel members and elongated members to provide cooperating surfaces when the elongated members are rotated relative to the channel members on the hinge means, and for preventing the spring means from retracting the elongated members in said rotated position;

a cross-member mounted between the elongated members which can serve as a step for a person wanting to climb aboard the watercraft from the water, and water foil means affixed to the cross member for creating a an upwardly directed drag force in the water when the water foil means is moved in the water, whereby movement in the water cause the elongated members to rotate upwardly on the hinge means and become retracted by the spring means.

2. The self-retracting step assembly of claim 1 wherein the channel members comprise tubing and wherein the elongated members comprise tubing of a lesser diameter than the channel members, the elongated members being telescopically mounted within the channel members.

3. The self-retracting step assembly of claim 1 wherein the spring means comprise coil springs.

4. The self-retracting step assembly of claim 1 wherein the water foil means are rotatably mounted relative to the cross member.

5. The self-retracting step assembly of claim 1 further comprising a pair of sliding members, each sliding member being mounted for sliding motion relative to one channel member, the sliding member being affixed to the elongated member and directly affixed to the spring means.

6. The self-retracting step assembly of claim 5 wherein the hinge means are mounted to the sliding member and to the elongated member.

7. The self-retracting step assembly of claim 6 wherein the channel member includes a blind slot, and the stop means comprise a pin affixed to the sliding member and traveling in the blind slot.

8. The self-retracting step assembly of claim 1 further comprising a second cross member rotatably mounted relative to the first cross member, the water foil means being fixedly mounted to the second cross member.

9. A self-retracting step assembly for a personal watercraft, comprising:

a pair of elongated channel members comprising aluminum tubing, the channel members being fixedly and substantially horizontally mountable to the rear of the personal watercraft in a position substantially parallel with one another;

a pair of sliding members comprising aluminum tubing, mounted within the interior of the channel members for relative sliding motion therein;

a pair of elongated members comprising aluminum tubing telescopically mounted within the channel members for relative sliding motion therein in a substantially horizontal direction, the elongated members being connected to the sliding members through a hinge pin which permits rotation about a horizontal axis;

spring means affixed to the channel members and to the sliding members for creating a substantially horizontal biasing force, biasing each sliding member and elongated member into a substantially retracted position relative to the channel member;

stop means for limiting the travel of each sliding member and of each elongated member relative to the channel member in the outward direction against the biasing force of the spring;

camming surface means formed at least on one of the channel members and elongated members to provide cooperating surfaces when the elongated members are rotated relative to the channel members and relative to the sliding members on the hinge pin, and for preventing the spring means from retracting the elongated members in said rotated position;

a cross-member fixedly mounted between the elongated members which can serve as a step for a person wanting to climb aboard the watercraft from the water, and water foil means rotatably affixed to the cross member for creating an upwardly directed drag force in the water when the water foil means is moved in the water, whereby movement in the water cause the elongated members to rotate upwardly on the hinge means and become retracted by the spring means.

10. The self-retracting step assembly of claim 9 wherein the spring means comprise coil springs.

11. The self-retracting step assembly of claim 10 further comprising a pin fixedly attached to each channel member, the coil spring being mounted to said pin.

12. The self-retracting step assembly of claim 11 wherein each channel member comprises a blind slot, the stop means comprise a pin fixedly attached to the sliding member and traveling in the slot.

13. The self-retracting step assembly of claim 9 further comprising a second cross member, the water foil means being fixedly mounted to the second cross member, and the second cross member being rotatably mounted to the first cross member.

14. The self-retracting step assembly of claim 13 wherein the water foil means is a substantially flat plate.

15. In combination a personal watercraft having a riding platform, and a self-retracting step assembly for the personal watercraft, comprising:

a pair of channel members being fixedly and substantially horizontally mountable to the rear of the personal watercraft;

a pair elongated members, each elongated member being mounted to one channel member for relative sliding motion thereon in a substantially horizontal direction;

spring means affixed to the channel members and to the elongated members for creating a substantially horizontal biasing force, biasing each elongated member into a substantially retracted position relative to the channel member;

stop means for limiting the travel of each elongated member relative to the channel member in the outward direction against the biasing force of the spring;

hinge means for permitting down and up rotation of the elongated members relative to the channel members when the elongated members are fully extended relative to the channel members;

camming surface means formed at least on one of the channel members and elongated members to provide cooperating surfaces when the elongated members are rotated relative to the channel members on the hinge means, and for preventing the spring means from retracting the elongated members in said rotated position;

a cross-member mounted between the elongated members which can serve as a step for a person wanting to climb aboard the watercraft from the water, and water foil means affixed to the cross member for creating a an upwardly directed drag force in the water when the water foil means is moved in the water, whereby movement in the water cause the elongated members to rotate upwardly on the hinge means and become retracted by the spring means.

16. The combination of claim 15 wherein the channel members comprise aluminum tubing and wherein the elongated members comprise aluminum tubing of a lesser diameter than the channel members, the elongated members being telescopically mounted within the channel members.

17. The combination of claim 15 wherein the water foil means are rotatably mounted relative to the cross member.

18. The combination of claim 15 further comprising a pair of sliding members, each sliding member being mounted for sliding motion relative to one channel member, the sliding member being affixed to the elongated member and directly affixed to the spring means.

19. The combination of claim 18 wherein the hinge means are mounted to the sliding member and to the elongated member.

20. The combination of claim 19 wherein the channel member includes a blind slot, and the stop means comprise a pin affixed to the sliding member and traveling in the blind slot.

* * * * *